US008538827B1

(12) United States Patent
Dryer et al.

(10) Patent No.: US 8,538,827 B1
(45) Date of Patent: Sep. 17, 2013

(54) REAL-TIME ALERT DURING ON-LINE TRANSACTION

(75) Inventors: Trevor D. Dryer, Mountain View, CA (US); Mark R. Shulman, Mountain View, CA (US); Matthew J. Homier, San Francisco, CA (US); Derrick R. Chao, San Francisco, CA (US)

(73) Assignee: Intuit Inc., Mountain View, CA (US)

( * ) Notice: Subject to any disclaimer, the term of this patent is extended or adjusted under 35 U.S.C. 154(b) by 32 days.

(21) Appl. No.: 13/098,137

(22) Filed: Apr. 29, 2011

(51) Int. Cl.
*G06Q 30/00* (2012.01)

(52) U.S. Cl.
USPC ..... 705/26.1

(58) Field of Classification Search
CPC ..... G06Q 30/00
USPC ..... 705/39, 26.1
See application file for complete search history.

(56) References Cited

U.S. PATENT DOCUMENTS

| | | | | |
|---|---|---|---|---|
| 6,038,552 | A | 3/2000 | Fleischl et al. | |
| 6,583,794 | B1 | 6/2003 | Wattenberg | |
| 7,249,092 | B2 | 7/2007 | Dunn et al. | |
| 7,366,684 | B1 * | 4/2008 | Douglas | 705/26.81 |
| 7,848,765 | B2 | 12/2010 | Phillips et al. | |
| 2002/0194079 | A1 * | 12/2002 | Kimble | 705/26 |
| 2003/0126100 | A1 | 7/2003 | Chithabraram | |
| 2004/0031856 | A1 * | 2/2004 | Atsmon et al. | 235/492 |
| 2006/0059085 | A1 | 3/2006 | Tucker | |
| 2006/0276180 | A1 | 12/2006 | Coulter, Jr. et al. | |
| 2007/0078760 | A1 | 4/2007 | Conaty et al. | |
| 2007/0106558 | A1 * | 5/2007 | Mitchell et al. | 705/16 |
| 2007/0149252 | A1 | 6/2007 | Jobs et al. | |
| 2008/0237336 | A1 * | 10/2008 | Bates et al. | 235/380 |
| 2008/0249984 | A1 | 10/2008 | Coimbatore | |
| 2009/0037461 | A1 | 2/2009 | Rukonic et al. | |
| 2010/0104078 | A1 | 4/2010 | Henry et al. | |
| 2010/0268629 | A1 | 10/2010 | Ross | |
| 2010/0312684 | A1 | 12/2010 | Kemper et al. | |
| 2012/0023011 | A1 * | 1/2012 | Hurwitz et al. | 705/39 |
| 2012/0197773 | A1 | 8/2012 | Grigg et al. | |
| 2012/0245989 | A1 | 9/2012 | Kakarla et al. | |

OTHER PUBLICATIONS

Non-Final Office Action dated Dec. 1, 2011 in U.S. Appl. No. 12/545,525, filed Aug. 21, 2009, (12 pages).
Amendment dated Feb. 23, 2012 in U.S. Appl. No. 12/545,525, filed Aug. 21, 2009, (27 pages).

(Continued)

*Primary Examiner* — Eric T Wong
(74) *Attorney, Agent, or Firm* — Vista IP Law Group LLP

(57) ABSTRACT

Systems, computerized methods and computer program products for alerting consumers during on-line transactions. A consumer utilizes a browser executing on a computer to begin an on-line transaction. An add-on such as a plug-in to the browser detects that the consumer has begun an on-line transaction. The add-on accesses an account of the consumer hosted by a financial management system and compares alert criteria and data of the on-line transaction and before the on-line transaction is completed, generates an alert that is displayed to the consumer if execution of the on-line transaction would generate a pre-determined result relative to the alert criteria, e.g., if the transaction causes the consumer to go over budget or a bank account balance would drop below a certain level. The alert can be a passive notification or an active alert that invokes a waiting or cooling off period or prevents the consumer from completing the transaction.

32 Claims, 16 Drawing Sheets

(56) References Cited

OTHER PUBLICATIONS

Interview Summary dated Feb. 27, 2012 in U.S. Appl. No. 12/545,525, filed Aug. 21, 2009, (3 pages).
Non-Final Office Action dated Feb. 3, 2012 in U.S. Appl. No. 12/710,977, filed Feb. 23, 2010, (33 pages).
Non-Final Office Action dated Oct. 13, 2011 in U.S. Appl. No. 12/771,990, filed Apr. 30, 2010, (11 pages).
Interview Summary dated Jan. 26, 2012 in U.S. Appl. No. 12/771,990, filed Apr. 30, 2010, (3 pages).
Amendment dated Feb. 6, 2012 in U.S. Appl. No. 12/771,990, filed Apr. 30, 2010, (10 pages).
Office Action dated Dec. 1, 2011, Amendment dated Feb. 23, 2012, Final Office Action dated Oct. 15, 2012 and Amendment dated Feb. 15, 2013 in U.S. Appl. No. 12/545,525, filed Aug. 21, 2009, (73 pages).
Final Office Action dated Nov. 26, 2012 in U.S. Appl. No. 12/710,977, filed Feb. 23, 2010, (17 pages).
Office Action dated Oct. 17, 2012 and Amendment dated Feb. 19, 2013 in U.S. Appl. No. 13/097,946, filed Apr. 29, 2011, (41 pages).

* cited by examiner

247

402a 402b

| ACCOUNT TYPE / BUDGET | CRITERIA / RULE |
|---|---|
| CHECKING ACCOUNT | MINIMUM BALANCE OF $1,000 |
| SAVINGS ACCOUNT | MINIMUM BALANCE OF $2,000 |
| CREDIT CARD 1 | MAXIMUM BALANCE $5,000 |
| CREDIT CARD 1 | MINIMUM CREDIT AVAILABLE OF $2,000 |
| DVD BUDGET | $50 PER MONTH |
| CLOTHING BUDGET | $100 PER MONTH |
| AMAZON.COM BUDGET | $200 PER MONTH |
| EBAY.COM BUDGET | $50 PER MONTH |
| MACYS.COM BUDGET | $200 PER MONTH |

FIG. 4

602a 602b

| ON-LINE TRANSACTION / WEBSITE DATA | TRANSACTION INDICATOR THAT TRIGGERS PLUG-IN TO DETERMINE WHETHER ALERT GENERATED? |
|---|---|
| URL ADDRESS | NO |
| URL ADDRESS + TRANSACTION WORD/PHRASE | YES |
| URL ADDRESS + CREDIT CARD DATA | YES |
| URL ADDRESS + CREDIT CARD DATA + TRANSACTION WORD/PHRASE | YES |
| MERCHANT NAME | NO |
| MERCHANT NAME + TRANSACTION WORD/PHRASE | YES |
| MERCHANT NAME + CREDIT CARD DATA | YES |
| MERCHANT NAME + CREDIT CARD DATA + TRANSACTION WORD/PHRASE | YES |
| TRANSACTION STATUS (ITEM ADDED TO SHOPPING CART) | YES |
| TRANSACTION STATUS (CHECKOUT) | YES |
| CREDIT CARD DATA | YES |
| CREDIT CARD DATA + TRANSACTION WORD/PHRASE | YES |
| CREDIT CARD DATA + TRANSACTION WORD/PHRASE + TRANSACTION STATUS | YES |

FIG. 6

April 2011 Budget ($200)

| Transactions (1002a) | Remaining Budget (1002b) | Over Budget? (1002c) | Alert? (1002d) |
|---|---|---|---|
| April 1 / $20 | $180 | N | N |
| April 3 / $75 | $105 | N | N |
| Current / $150 | ($45) | Y | Y |

FIG. 10A

April 2011 Budget ($200)

| Transactions (1002a) | Remaining Budget (1002b) | Over Budget? (1002c) | Within Pre-Determined Amount ($25) of Budget? (1002e) | Alert? (1002d) |
|---|---|---|---|---|
| April 1 / $20 | $180 | N | N | N |
| April 3 / $75 | $105 | N | N | N |
| Current / $100 | $5 | N | Y | Y |

FIG. 10B

Credit Card Limit ($5,000)

| 1012a Balance | 1012b Transactions | 1012c Remaining Credit | 1012d Over Credit Limit? | 1012e Alert? |
|---|---|---|---|---|
| $4000 | | | | |
| | April 1 / $200 | $800 | N | N |
| | April 3 / $250 | $550 | N | N |
| | Current / $800 | (300) | Y | Y |

FIG. 10C

Credit Card Limit ($5,000)

| 1012a Balance | 1012b Transactions | 1012c Remaining Credit | 1012d Over Credit Limit? | 1012f Within Pre-Determined Amount ($200) of Credit Limit? | 1012e Alert? |
|---|---|---|---|---|---|
| $4000 | | | | | |
| | April 1 / $200 | $800 | N | N | N |
| | April 3 / $250 | $550 | N | N | N |
| | Current / $500 | $50 | N | Y | Y |

FIG. 10D

Minimum Balance of Account Used to Pay for On-Line Transactions ($2,000)

| 1022a | 1022b | 1022c | 1022d | 1022e |
|---|---|---|---|---|
| Start Bal | Transactions | End Bal | End Bal < Min Bal? | Alert? |
| $3000 | | | | |
| | April 1 / $200 | $2800 | N | N |
| | April 3 / $250 | $2500 | N | N |
| | Current / $800 | $1750 | Y | Y |

FIG. 10E

Minimum Balance of Account Used to Pay for On-Line Transactions ($2,000)

| 1022a | 1022b | 1022c | 1022d | 1022f | 1022e |
|---|---|---|---|---|---|
| Start Bal | Transactions | End Bal | End Bal < Min Bal? | End Bal w/i Pre-Determined Amount ($200) of Min Bal? | Alert? |
| $3000 | | | | | |
| | April 1 / $200 | $2800 | N | N | N |
| | April 3 / $250 | $2550 | N | N | N |
| | Current / $500 | $2005 | N | Y | Y |

FIG. 10F

REAL-TIME ALERT DURING ON-LINE TRANSACTION

BACKGROUND

The invention is generally related to electronic commerce, and more particularly, to on-line shopping. Consumers purchase various items on-line from merchant websites such as AMAZON.COM, EBAY.COM and other websites using a credit card or other form of electronic payment. Given the ease and speed with which on-line shopping can be performed, it is not uncommon for consumers to be more likely to purchase items on-line from the comfort of their homes or offices, particularly considering electronic payment is utilized for payment. As such, consumers may not appreciate how much an item actually costs since the consumer is not at the store and not paying with cash or writing a check, which may cause the consumer to better understand or appreciate the cost. Thus, consumers occasionally make "impulse" on-line purchases. They browse merchant websites, see what they want, and click a button to purchase an item, and can receive the item quickly at their door without ever stepping foot into a merchant store, and often times without paying sales tax and/or shipping costs.

Given the ease, benefits and speed of on-line shopping, consumers often fail to review their budgets or financial accounts, particularly since on-line transactions can be completed very quickly with a click of a button. Thus, consumers are not inclined to stop their on-line shopping experience and take the time to log into one or more separate accounts to assess budgets, credit card limits and/or fund availability. These extra steps are inconvenient and time consuming and are often not even considered by consumers when making on-line purchases, particularly when websites such as AMAZON.COM store credit card information such that consumers can simply select a previously used credit card for a purchase, further contributing to impulsive and speed of on-line purchases. On-line shopping can have an element of excitement such that the consumer is not interested in budgets or financial summaries.

Thus, consumers often experience post-transaction regret by realizing later (e.g., when the consumer receives a credit card bill) that an on-line purchase caused the consumer to go over budget or other financial difficulties. This after the fact accounting can cause problems and complications with consumer finances and budgets.

SUMMARY

Certain embodiments are related to computer-implemented methods for alerting a consumer during an on-line transaction. One method embodiment includes detecting, with an add-on (such as a plug-in) to a web browser executing on a first computer of the consumer, when the consumer is in the process of purchasing an item from the merchant during an on-line transaction during which the consumer accesses a website hosted by a second computer of the merchant. The first computer with the plug-in accesses an account of the consumer hosted by a financial management system (FMS) in response to detecting an on-line transaction before the on-line transaction is completed. For this purpose, for example, the add-on may utilize an application program interface (API) of the FMS to identify data of the consumer's account, financial summary, budget or profile.

The account, financial summary, budget or profile includes or specifies alert criteria. The first computer with the plug-in compares data of the on-line transaction and the alert criteria, and generates an alert that is displayed to the consumer if execution of the on-line transaction would generate a pre-determined result relative to the alert criteria before the on-line transaction has been completed, e.g., if the transaction causes an account balance to fall below a specified balance.

A further embodiment is directed to a method for receiving a real-time alert during an on-line transaction. The method comprises downloading an add-on to a web browser (such as a plug-in to the browser) that executes on a first computer of a consumer (such as a desktop or laptop computer or mobile communication device that has computing components for conducting on-line transactions). The method further comprises visiting a merchant website hosted by a second computer using the web browser, beginning an on-line transaction at the merchant website using the web browser, and before the on-line transaction has been completed, viewing an alert generated by the add-on and generated based at least in part upon a pre-determined result relative to the alert criteria that would occur if the on-line transaction is allowed to be completed. The consumer may then respond to the alert and, in certain embodiments, complete the on-line transaction. In other embodiments, the plug-in interrupts or blocks the on-line transaction.

Yet another embodiment is directed to a system for alerting a consumer during an on-line transaction that comprises an add-on to a web browser (such as a plug-in) and a financial management system. The web browser executes on a first computer of the consumer and is programmed, configured or operable to detect when the consumer is in the process of purchasing an item from the merchant during an on-line transaction involving a second computer of a merchant in communication with the first computer. In response, the add-on communicates with a third computer to access data of a FMS utilized by the consumer to access an account, financial summary, budget or profile of the consumer hosted by the FMS. The account comprises alert criteria, and the add-on is operable to compare the alert criteria with on-line transaction data before the on-line transaction has been completed, and generate an alert that is displayed to the consumer if execution of the on-line transaction would generate a pre-determined result relative to the alert criteria.

Another embodiment is directed to an add-on such as a plug-in to a web browser that is operable to alert a consumer during an on-line transaction while the consumer utilizes a first computer to access a second computer of a merchant. The add-on is downloadable to the first computer through a second network and being operable to detect when the consumer in the process of purchasing an item from the merchant during the on-line transaction, and communicate with a financial management system hosted by a third computer through a third network to access an account, financial summary, budget or profile of the consumer hosted by the financial management system in response to detecting the on-line transaction. The account comprises alert criteria accessed by the add-on before the on-line transaction is completed. The add-on is operable to compare data of the on-line transaction and the alert criteria, and generate an alert that is displayed to the consumer if execution of the on-line transaction would generate a pre-determined result relative to the alert criteria before the on-line transaction has been completed.

A further embodiment is directed to a computer program product comprising a non-transitory, computer readable storage medium having instructions which, when executed by a first computer of a consumer, cause the one or more processors to execute a process for alerting the consumer during an on-line transaction, the process comprising detecting when the consumer is in the process of purchasing an item from the merchant during an on-line transaction involving a second computer of a merchant in communication with the first computer, accessing an account, financial summary, budget or profile of the consumer hosted by a financial management system in response to detecting the on-line transaction, the account comprising alert criteria accessed by the add-on before the on-line transaction is completed, comparing data of the on-line transaction and the alert criteria, and generating an alert that is displayed to the consumer if execution of the on-line transaction would generate a pre-determined result relative to the alert criteria before the on-line transaction has been completed.

In a single or multiple embodiments, the add-on detects that the consumer is in the process of purchasing the item during the on-line transaction based at least in part upon at least one transaction indicator, which may be data displayed by the web browser. The transaction indicator may be a pre-determined URL address or pre-determined on-line merchant (e.g., AMAZON, AMAZON.COM, E-BAY, E-BAY.COM), a pre-determined word or phrase associated with an on-line transaction (e.g., "shopping card" or "checkout" or transaction terms such as "tax," "total," "shipping address," and "billing address,", and a credit card number or portion thereof (e.g., while the consumer is in the process of typing the credit card number).

In a single or multiple embodiments, whether an alert is generated by the add-on may depend upon whether execution of the on-line transaction to purchase the item lead to a pre-determined result such as the consumer exceeding a predetermined credit card balance, exceeding a predetermined budget amount for purchases of the item, exceeding a predetermined budget amount for purchase from the merchant, or a balance of a financial account (e.g., checking or savings) of the consumer falling below a predetermined minimum balance.

In a single or multiple embodiments, the alert is displayed in response to the consumer visiting a certain URL address of a merchant and/or at different stages of an on-line transaction, e.g., when the consumer adds an item to an electronic shopping cart of a website of the merchant, when the consumer proceeds to checkout with the item already added to an electronic shopping cart, when the consumer selects a credit card or manually enters credit card information.

In a single or multiple embodiments, the alert is a passive alert. In other words, the add-on does not exert any control over the consumer or the website. For example, the alert may be in the form of an informative notification or warning within a pop-up window or other message format indicating that execution of the on-line transaction at issue would result in the consumer's savings account falling below a minimum balance.

In other embodiments, the alert is an active alert that may impart some type of control over the consumer computer and/or website to affect how the consumer can proceed with the on-line transaction if at all. For example, the alert may institute a waiting or cooling off period before the consumer is allowed to complete the on-line transaction. The alert may also present the consumer with various choices or input elements for canceling the transaction, proceeding with the transaction, or saving or bookmarking the transaction so that the transaction is not completed when the alert is issued but the consumer can revisit the transaction at a later time. The waiting or cooling off period, which may be 30 seconds, minutes, hours, days, weeks or months, may be selected by the consumer as part of an alert setup or configuration. The alert may also interact with the browser and/or merchant website to disable certain features to prevent the consumer from proceeding with the on-line transaction, or redirect the consumer to another website.

In a single or multiple embodiments, the add-on may be a plug-in to a web browser, examples of which include, but are not limited to, GOOGLE CHROME, INTERNET EXPLORER, MOZILLA FIREFOX, etc., and a financial management system may, for example, be FINANCEWORKS, MINT, QUICKEN, MICROSOFT MONEY, etc.

BRIEF DESCRIPTION OF THE DRAWINGS

The foregoing and other aspects of embodiments are described in further detail with reference to the accompanying drawings, wherein:

FIG. 4 is a table that is accessed by an add-on to a web browser and that illustrates different types of alert criteria for respective types of accounts and budgets;

FIG. 6 is a table that is accessed by an add-on to a web browser and that illustrates different types of transaction indicators that may trigger the add-on to compare data of a pending on-line transaction and alert criteria;

FIGS. 10A-F illustrate examples of situations in which an add-on or plug-in to a web browser generates an alert that is displayed to a consumer during an on-line transaction based at least in part upon a consumer budget, available credit and minimum account balances.

DETAILED DESCRIPTION OF ILLUSTRATED EMBODIMENTS

Figure 1:
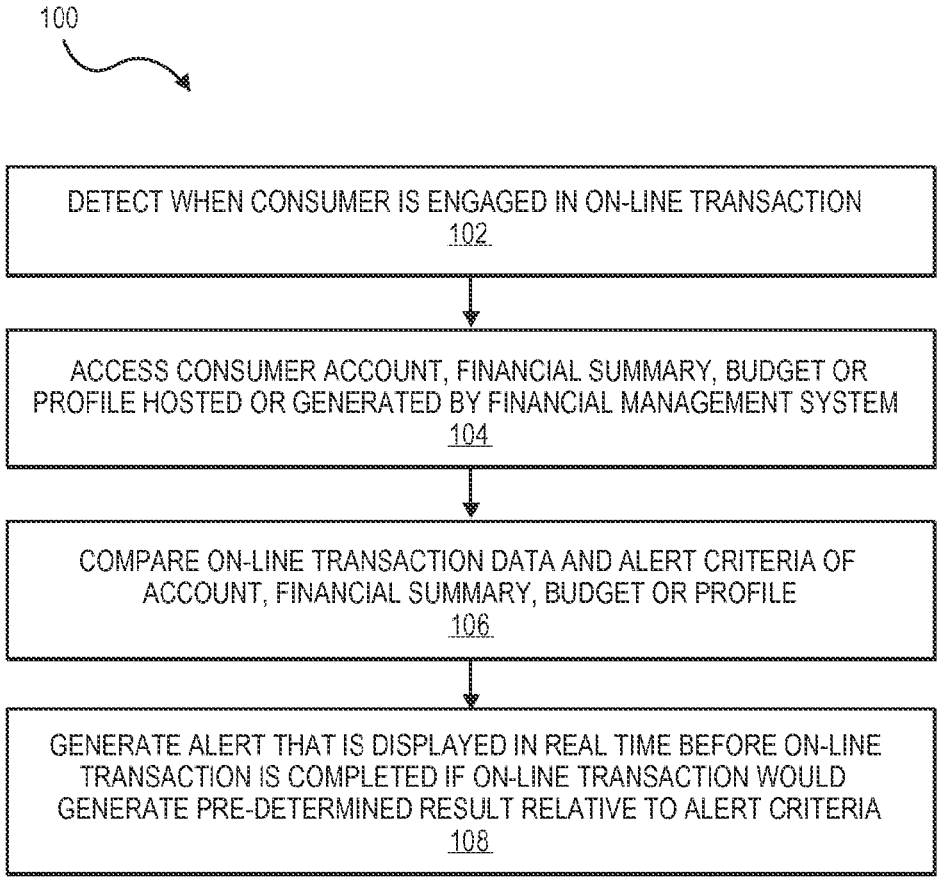
FIG. 1 is a flow chart illustrating one embodiment of a method for alerting consumers in real time during an on-line transaction.

Embodiments are related to providing real-time alerts to consumers during an on-line transaction, i.e., before the on-line transaction has been completed such as before a consumer clicks "Proceed to Checkout" or "Place Your Order" to purchase an item and charge a credit card. In certain embodiments in which a browser executes on a computer to access a merchant website, the consumer downloads an add-on such as a plug-in to the browser. The browser is used to navigate pages of a merchant website and to begin an on-line transaction to purchase an item. Referring to FIG. 1, according to one embodiment of a method 100 for providing real-time alerts during on-line transactions involves a plug-in monitoring the consumer's activities or associated data and at 102, determining or detecting when the consumer has begun or is in the process of an on-line transaction. At 104, the plug-in accesses an account, financial summary, budget or profile (generally, account or financial summary) of the consumer hosted by a financial management system (FMS), examples of which include QUICKEN, MINT, FINANCEWORKS, MICROSOFT MONEY and/or another source with budget or bank or credit card account data. The plug-in compares alert criteria and data of the on-line transaction at 106, and before the on-line transaction is completed, generates an alert at 108. The alert is displayed to the consumer if execution of the on-line transaction would generate a pre-determined result (e.g., the consumer would go over budget or a checking account balance would fall below a minimum balance).

For example, the plug-in may generate an alert in the form of a pop-up window with a message informing the consumer about how the amount of the on-line purchase would cause the consumer to go over budget for a certain period of time, for a certain category or type of purchase, or purchases made from a certain merchant. In this manner, consumers are alerted of potential budget or finance issues before an on-line transaction is completed as opposed to after the transaction is completed so that the consumer, knowing that information beforehand, is informed about how that transaction will affect the consumer's budgets or finances. Otherwise, if the comparison would not generate a pre-determined result (e.g., the purchase would not cause the consumer to go over budget), the plug-in executes in the background without generating an alert or notification and without interrupting the on-line transaction. Further aspects of embodiments are described in further detail with reference to FIGS. 2A-11.

Figure 2A:
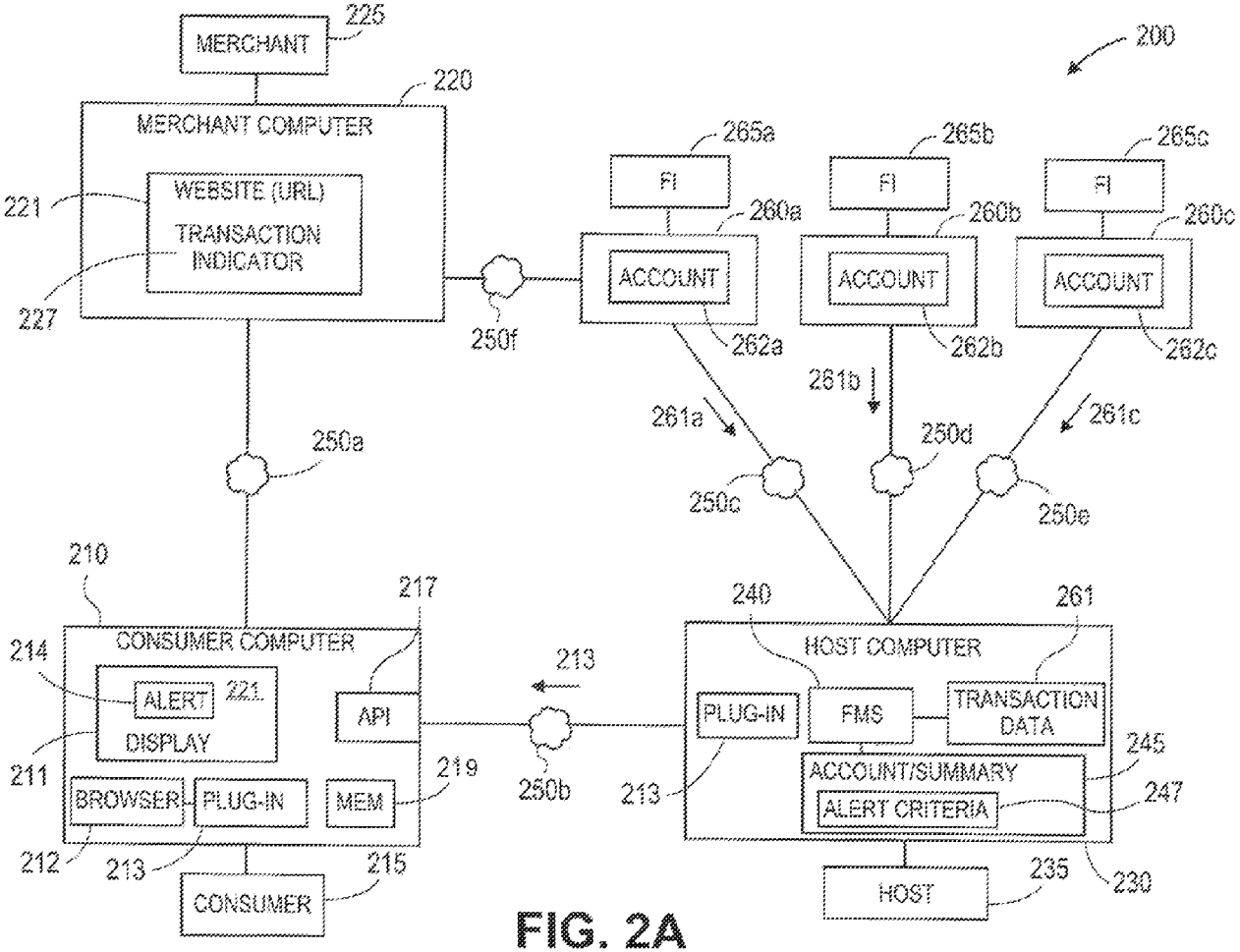
FIGS. 2A-B illustrate embodiments of systems constructed according to certain embodiments for alerting consumers in real time during an on-line transaction utilizing an add-on such as a plug-in to a web browser utilized to access a merchant website and execute an on-line transaction.
Figure 2B:
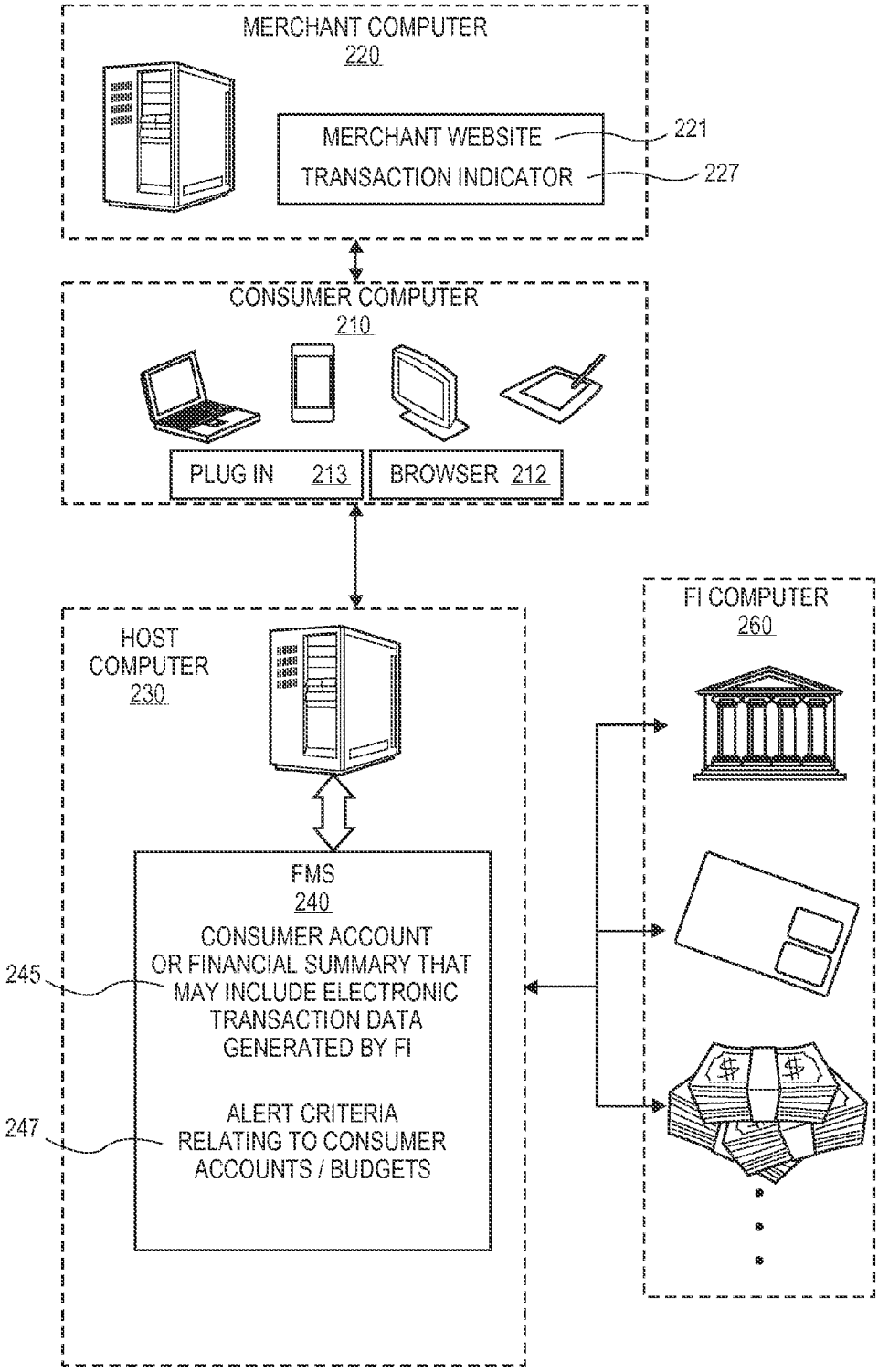

Referring to FIGS. 2A-B, a system 200 constructed according to one embodiment for generating real-time alerts 214 during an on-line transaction comprises or involves a consumer 215 that utilizes a computing apparatus 210, a merchant 225 that operates a website 221 hosted on merchant computer 220, and a host 235 that manages a computer 230 including a financial management system 240 (FMS 240). Consumer computer 210 is in communication with or operably coupled to merchant computer 220 and host computer 230 via respective networks 250*a-b*. In the illustrated embodiment, the FMS 240 is in communication with computers 260*a-c* (generally, 260) of respective financial institutions 265*a-c* (generally, FI 265) via respective networks 250*c-e*. Merchant computer 220 is also in communication with one or more FI computers via network 250*f*, e.g., a computer of a credit card company. In certain embodiments, FMS 240 receives electronic transaction data 261*a-c* (generally, 261) generated or stored by FI computers 260 and incorporates electronic transaction data 261 into an account, financial summary, budget or profile (generally, account or financial summary 245) of the consumer 215. The account or financial summary 245 can be generated by the FMS 240 or by the consumer 215 using the FMS 240. In other embodiments, the account or financial summary 245 is generated by the consumer 215 using the FMS 240, and it is not necessary for the FMS 240 to integrate electronic transaction data 261 received from FI computers 260 into the account or financial summary 245. Thus, FIGS. 2A-B are provided to show one embodiment in which FMS 240 receives electronic transaction data 261 from FI computers 260.

Examples of networks 250*a-e* (generally, 250) that may be utilized for communications between system 200 components include but are not limited to a Local Area Network (LAN), a Wide Area Network (WAN), Metropolitan Area Network (MAN), a wireless network, other suitable networks capable of transmitting data, and a combination of such networks. For ease of explanation, reference is made to a network 250 generally, but various networks, combinations of networks and communication systems, methods and protocols may be utilized.

The consumer computing apparatus 210 may be a desktop computer, laptop computer or other computing device such as a tablet computing device or mobile communication device such as a cellular telephone or Smartphone capable of wireless or cellular communication with the merchant computer 220 and host computer 230. For ease of explanation, reference is made generally to a consumer computer 210, which is defined to include computers and mobile and tablet computing devices capable of such communications.

In the illustrated embodiment, the consumer computer 210 includes a display 211, and a web browser 212 that executes on the consumer computer 210 to display pages of a website 221 (generally, website or website pages 221) of the merchant 225 to the consumer 215. Examples of web browsers 212 that may be utilized in embodiments include, for example, INTERNET EXPLORER, GOOGLE CHROME, MOZILLA FIREFOX. For ease of explanation, reference is made generally to a plug-in 213 to a web browser 212. The consumer 215 navigates website pages 221 to view merchant 225 offerings and purchase items on-line from the merchant 225. In the illustrated embodiment, an add-on 213, such as a plug-in to the web browser 212, is downloaded to the consumer computer 220, e.g., from host computer 230 or another source and executed to implement embodiments or aspects thereof.

In the embodiment illustrated in FIG. 2, the computer 230 hosts FMS 240 and plug-in 213 may be downloaded from the FMS 240 or host computer 230 to the consumer computer 210. Consumer 215 has an account or financial summary 245 prepared using or by the FMS 240. The FMS 240 may, for example, be utilized to collect, organize and store financial and transaction data 261 and generate and present financial summaries 245 such as spending summaries, income summaries, budgets, etc. to the consumer 215 so that consumers 215 can analyze their spending, view spending categories, observe spending patterns, spending on certain items and purchases from certain merchants. Examples of a FMS 240 that may be utilized or adapted for use in embodiments include QUICKEN, MINT, FINANCEWORKS, and MICROSOFT Money. QUICKEN, MINT and FINANCEWORKS are registered trademarks of Intuit Inc., Mountain View, Calif.

In the illustrated embodiment, the plug-in 213 executes on consumer computer 210 and may utilize an application program interface (API) 217 or other suitable communications interface to communicate with the FMS 240 via network 250*b*. The plug-in 213 is operable to capture, scan or read data of website pages 221 displayed to or visited by the consumer 215 as the consumer 215 as the consumer 215 navigates the website 221 to select an item to purchase on-line. For this purpose, the plug-in 213 may be configured or operable to perform or employ screen scraping or scanning of source data of the website 221 to determine whether the consumer 215 has begun or is in the process of an on-line transaction with the merchant 225.

The FMS 240 may be a stand-alone program utilized by consumer 215 or in communication with computers 260 of FIs such as a bank, credit union or credit card company to receive electronic financial or transaction data 261 of the consumer 215. For example, the consumer 215 may have respective bank accounts 262*a-c* (generally, bank or FI account 262) such as a checking, savings or credit card account that includes respective item-level transaction data 261*a-c* that may include account balances, transaction data (deposits, withdrawals, bill pay, etc.), credit limits, available credit, etc. A FMS 240 that may be utilized for these purposes includes, for example, desktop or on-line FMS 240 (as shown in FIGS. 2A-B) such as QUICKEN, MINT, FINANCEWORKS and MICROSOFT MONEY.

Thus, a FMS 240 is defined to include, any computing system implemented, on-line or web-based, system, package, program, module, or application that gathers financial and/or transaction data, has the capability to receive or retrieve and/or analyze such data and categorize at least part of the data into various reports or displays that are provided to consumer 215, and provides consumer 215 with the capability to conduct, and/or monitor, financial transactions and data.

Figure 3:
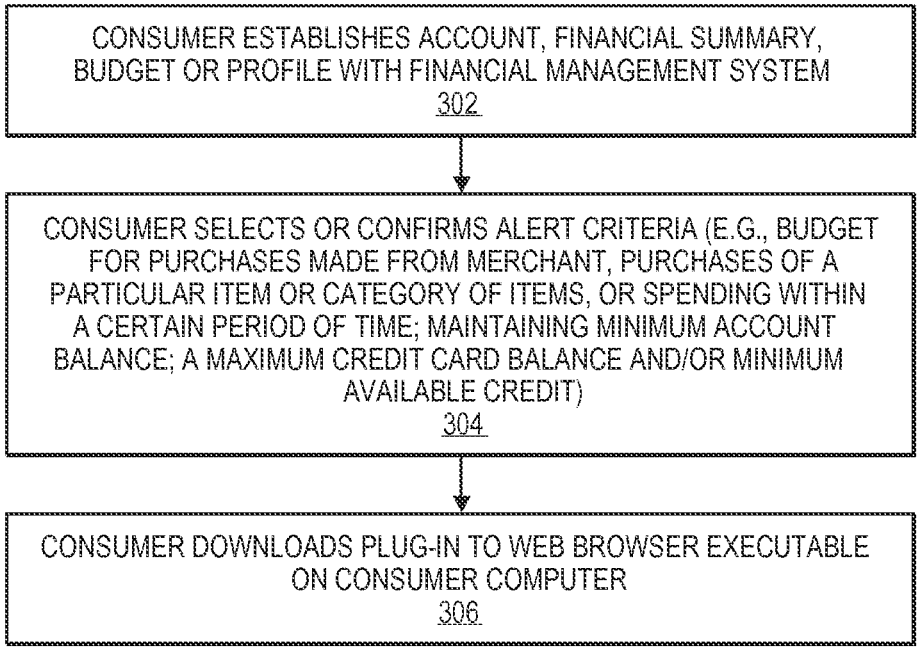
FIG. 3 illustrates method steps during which a consumer registers with or utilizes a financial management system and downloads an add-on to the web browser.

Referring to FIG. 3, before the consumer 215 visits a merchant website 221 to engage in on-line shopping, at 302, the consumer 215 registers with or opens an account or financial summary 245 with the FMS 240. For this purpose, the consumer 215 may provide information such as name, e-mail address, user ID and password and, if desired, information to allow the FMS 240 to link to the consumer's FI accounts 262 so that the FMS 240 can receive data 261 such as account balances, transactions etc. from FI computers 260 if such data is not entered or updated by the consumer 215. The financial summary or account 245 allows the consumer 215 to track, organize and/or categorize transaction data 261 of one or more FIs 260 or to track, organize and/or categorize manually entered data.

At 304, the consumer 215 selects or confirms alert criteria or rules 247 including, but not limited to, a budget for purchases made from merchant 225, a budget for purchases of a particular item or category of items, or a budget for a certain period of time; maintaining minimum account balance; a maximum credit card balance and/or minimum available credit.

Referring to FIG. 4, alert criteria or rules 247 selected or confirmed by the consumer 215 may involve various types of bank accounts 262 or budgets of the consumer 215. As generally shown in FIG. 4, the FMS 240 may generate and store a table including a column 402*a* for account or budget type and a column 402*b* for the corresponding criteria or rule. For example, the consumer 215 may have checking, savings and credit card accounts, and the account or financial summary 245 may be based particular items or categories of items (e.g., shirts and jeans are categorized as "clothing" by the FMS 240 and purchases made from a grocery store may be categorized as "food'). For example, the consumer 215 has specified that a checking account balance should not fall below $1,000, the balance due on a credit card should not exceed $5,000, and the consumer 215 has budgeted to spend up to $200 per month on purchases from AMAZON.COM. It will be understood that different accounts and budgets may be utilized, and that the alert criteria or rule 247 for each of those accounts and budgets may vary. Accordingly, FIG. 4 is provided to generally illustrate how consumer 215 can select or confirm alert criteria or rules 247 for different bank accounts, balances, available credit, different merchants and items or categories thereof.

Referring again to FIG. 3, at 306, the consumer 215 downloads the plug-in 213 to the web browser 212 so that the plug-in 213 executes on the consumer computer 210. In the illustrated embodiment, the plug-in 213 is downloaded to the consumer computer 210 from the host computer 230 or FMS 240. In other embodiments, the plug-in 212 can be downloaded from another computer that does not host the FMS 240.

Figure 5:
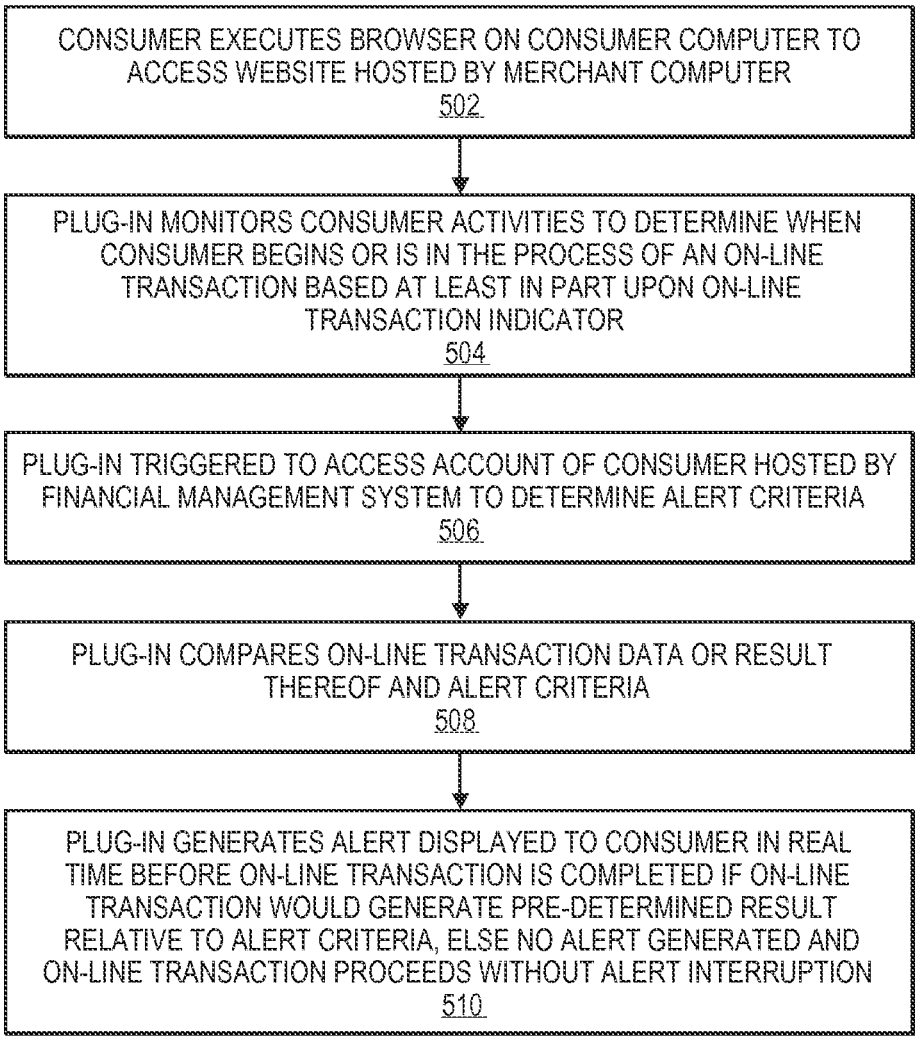
FIG. 5 is a flow diagram of one embodiment of a method for alerting consumers in real time during an on-line transaction using an add-on or plug-in to a web browser.

Referring to FIG. 5, and with continuing reference to FIGS. 2A-B, having downloaded the plug-in 213, the consumer 215 wishes to browse a merchant website 221 for on-line shopping, and at 502, executes the browser 212 to access a merchant website 221 such as AMAZON.COM. At 504, the plug-in 213 monitors the consumer's activities on the website 221 (e.g., by screen scraping or scanning HTML source code of the website pages 221 displayed) to determine when the consumer 215 has initiated or is in the process of an on-line purchase or transaction. For this purpose, the plug-in 213 is operable, programmed or configured to monitor data of the website 221 during consumer navigation and data selection or entry to identify any on-line transaction indicators 227 or keywords, phrases and/or numbers associated with the consumer 215 being engaged in an on-line transaction (and before the transaction is completed).

Referring to FIG. 6, the plug-in 213 may access a table of possible on-line transaction indicators 227. The table may be downloaded and stored in local memory 219 of the consumer computer 215 when the plug-in 213 is downloaded, or the plug-in 213 may access the table stored on another computer via a network as shown in FIG. 2A. In the illustrated example, the first column 602*a* of the table includes examples of different transaction indicators 227 related to the consumer's interaction or progress of an on-line transaction, and column 602*b* indicates whether such data is a transaction indicator 227 that would trigger the plug-in 213 to analyze whether it is necessary to generate and display an alert 214 to the consumer 215 during the on-line transaction.

For example, in the illustrated embodiment, even if the consumer 215 is at a website 221 known to be an on-line merchant such as AMAZON.COM, EBAY.COM or MACY-S.COM, the plug-in 213 is configured to determine that such browsing activity, by itself, is not a transaction indicator 227 that warrants further action. In other embodiments, the plug-in 213 can be configured to be triggered to determine whether an alert 214 is necessary based on the website visited (e.g., according to a pre-determined Uniform Resource Locator (URL) address).

In the illustrated embodiment, a transaction indicator 227 requires more involvement by the consumer 215 who has navigated to a point of beginning a transaction such that the displayed page of the web site 221 includes words, phrases or numbers associated with an on-line transaction and/or credit card data. In these cases, the these types of data are transaction indicators 227 that trigger the plug-in 213 to analyze the on-line transaction data to determine how the transaction affects or relates to alert criteria 247 such as a budget, minimum account balance, etc. as discussed above.

Figure 7:
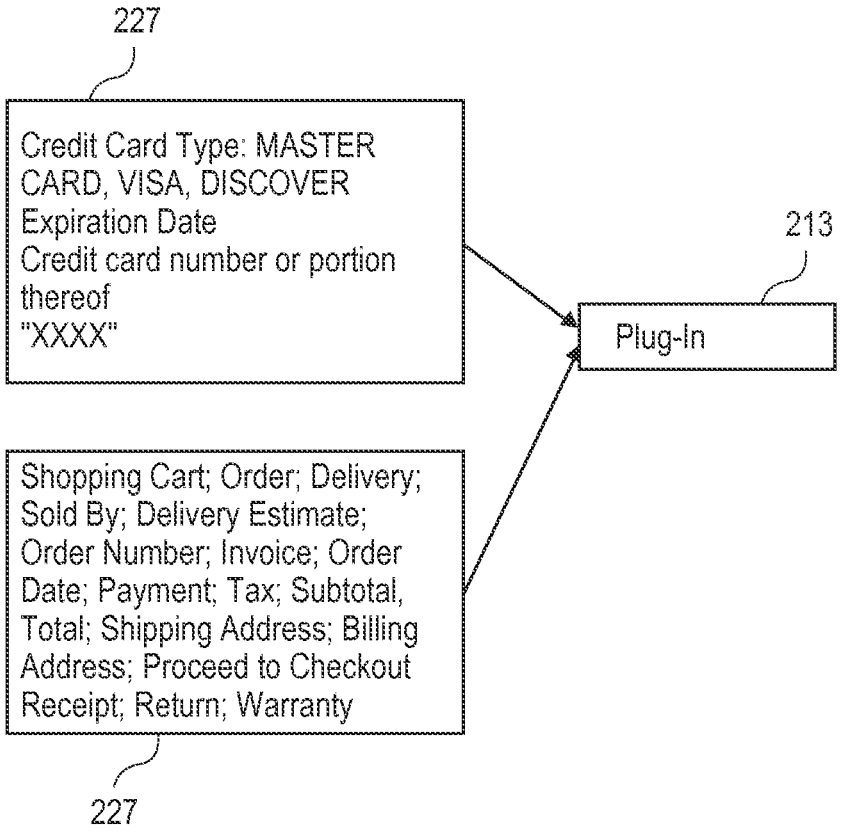
FIG. 7 generally illustrates different types of inputs that may be received by an add-on or plug-in to a web browser according to embodiments.
Figure 8A:
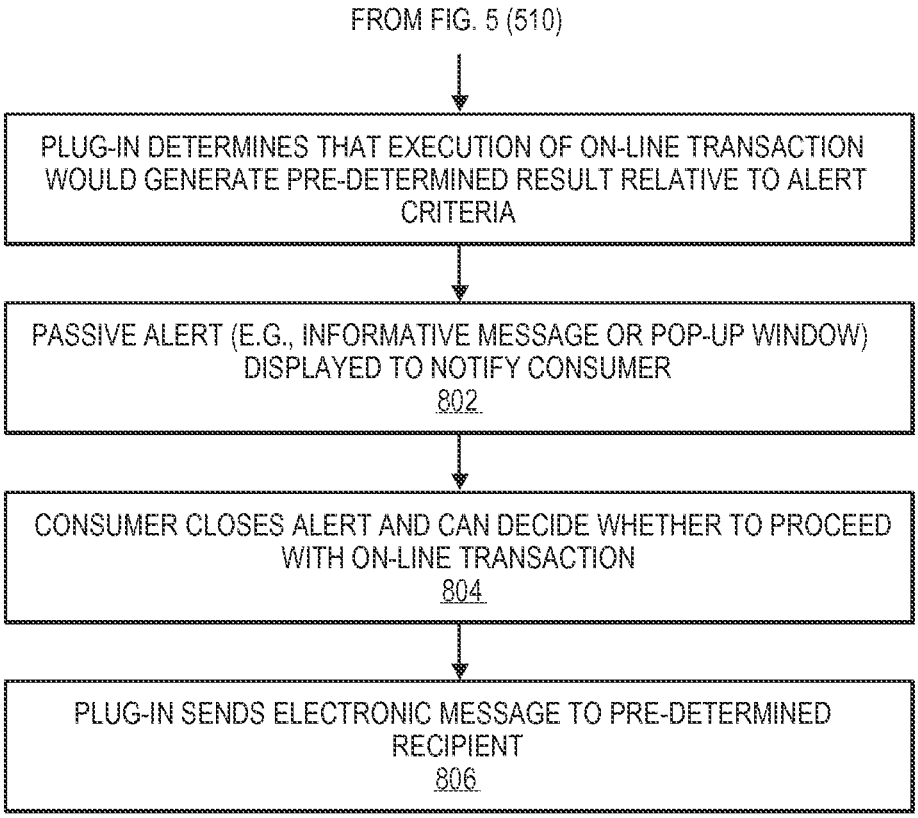
FIG. 8A is a flow diagram of generating a passive alert during an on-line transaction according to one embodiment.
Figure 8B:
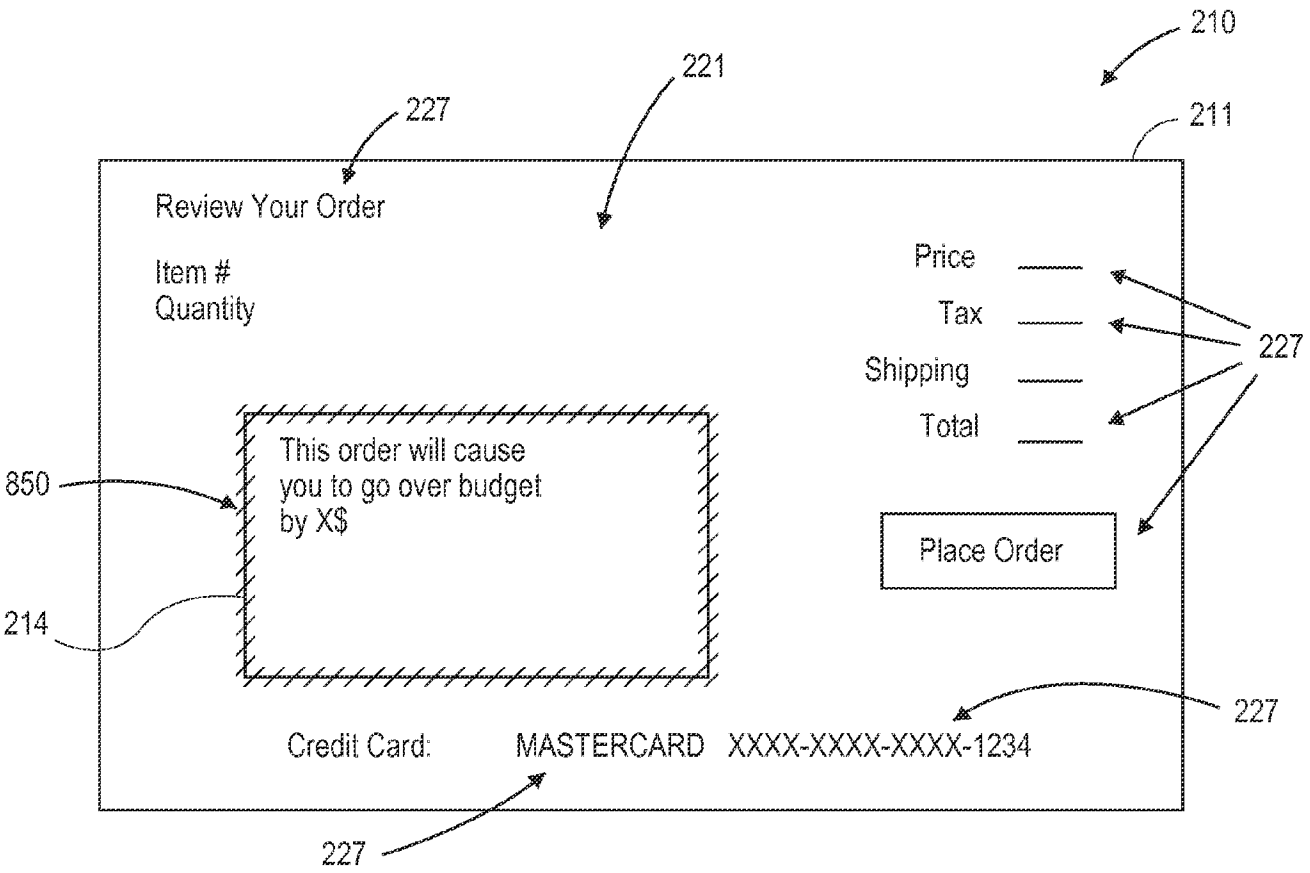
FIG. 8B illustrates an example of a passive alert in the form of a pop-up window.

Referring to FIG. 7, as a more detailed example, the plug-in 213, in one embodiment, scraps, scans, reads or receives data in the form of words, phrases and/or numbers related to the consumer 215 selecting items and/or deciding to purchase selected items, and a credit card selected or entered by the consumer 215. In the illustrated embodiment, transaction indicators 227 are in the form of keywords, phrases or numbers that indicate one or more of the consumer 215 has selected an item, added the item to a shopping cart, and is about to check out and purchase the item.

For example, the following words and phrases can be classified as transaction indicators 227 that trigger the plug-in 213 to determine whether an alert 214 should be generated: cart, shopping cart, delivery, sold by, delivery estimate, order number, invoice number, order date, payment, tax, total, shipping address, billing address, proceed to checkout, receipt, return and warranty. These words and phrases are classified as transaction indicators 227 since they all relate to a point in time during a transaction, i.e., before the transaction is completed and the order is placed.

Further, in the illustrated embodiment, transaction indicators 227 may be in the form of credit card data of the name of the issuer bank (e.g., MASTERCARD, VISA, DISCOVER), expiration date, and a credit card number, portion thereof, or blocked out portion thereof (e.g., "XXXX"), all of which indicate that the consumer 215 has selected an item, added the item to a shopping cart, and is about to check out and complete the on-line transaction using the credit card.

Referring again to FIG. 5 and with continuing reference to FIGS. 6-7, the presence of a transaction indicator 227 triggers the plug-in 213 at 506. When triggered, the plug-in 213 accesses the account or financial summary 245 of the consumer 215 generated with or hosted by the FMS 240 to determine whether an alert 214 should be displayed to the consumer 215 before the on-line transaction is completed. For this purpose, the plug-in 213 may access the FMS 240 via a network 250, the FMS 240 may execute locally on the consumer computer 210 and receive updates periodically from the FMS 240 hosted on computer 230, or the account or financial summary 245 can be generated on or downloaded and stored locally to the consumer computer 210 and updated periodically to eliminate accessing the FMS 240 when the plug-in 213 is triggered.

For this purpose, the plug-in 213 receives or determines on-line transaction data (e.g., one or more of transaction amount, items to be purchased, categories of items to be purchased, the merchant, the URL address of the website 221), and compares, in real time before the on-line transaction has been completed, data of the on-line transaction data or a result of executing the on-line transaction to the pre-determined alert criteria 247 (described above with reference to FIG. 4). At 510, the plug-in 213 generates an alert 214 that is displayed to the consumer 215 in real time before on-line transaction is completed if the on-line transaction would generate pre-determined result (e.g., credit card balance would exceed the maximum balance selected by the consumer, or a balance of an account used to pay credit card bills would drop below a minimum balance that was previously specified by the consumer). Otherwise, if the on-line transaction would not generate a pre-determined result, then no alert 214 is generated, and the plug-in 213 analysis is transparent to the consumer 215 who proceeds to complete the on-line transaction without being interrupted by the plug-in 213.

For example, referring again to FIG. 4, in the illustrated embodiment, the consumer 215 specified that the maximum balance on Credit Card 1 should not exceed $5,000. The plug-in 213, upon determining that execution of the on-line transaction using that credit card would result in a credit card balance of $5,500 would trigger the plug-in 213 to generate an alert 214, which would inform the consumer 215 that execution of the on-line transaction will result in exceeding the previously specified maximum credit card balance of $5,000. However, if the on-line transaction using that credit card would not exceed the previously specified maximum balance, no alert 214 would be generated.

As another example, in the illustrated embodiment, the consumer 215 specified a budget in which purchases from a particular merchant 225, such as AMAZON.COM, should not exceed $200 per month. The plug-in 213, upon determining that execution of the on-line transaction would be $300 during that same time period would trigger the plug-in 213 to generate an alert 214 to inform the consumer 215 that execution of the on-line transaction would cause the consumer 215 to go over the $200 AMAZON.COM budget. However, if the on-line transaction would not exceed the previously specified budget for purchase from AMAZON.COM, then no alert 214 would be generated. It will be understood that the plug-in 213 may analyze one or multiple account attributes or budgets, and that an alert 214 may be triggered based on one or more results relative to these accounts or budgets. Thus, FIG. 4 is provided as an example of the types of data that may be transaction indicators 227 that trigger the plug-in 213 to access an account or financial summary 245 and compare alert criteria 247 with data of the on-line transaction data to determine whether to generate a real-time alert 214.

The plug-in 213 can alert 214 the consumer 215 in various ways and be passive or active by invoking some type of control over or interruption to the consumer 215 before the on-line transaction is completed. For example, referring to FIGS. 8A-B, according to one embodiment, step 510 from FIG. 5 involves the plug-in 213 being triggered to access alert criteria 247 (e.g., a pre-determined budget for AMAZON-.COM purchases), compare the alert criteria 247 to data of the on-line transaction to determine that execution of the on-line transaction would generate pre-determined result (e.g., go over budget) relative to the alert criteria 247. In the embodiment shown in FIG. 8B, at 802, the alert 214 generated by the plug-in 213 and displayed to the consumer 215 in the form of a pop-up window 850 or other message format that informs the consumer 215, for example, that this on-line transaction will cause the consumer 215 to go over the AMAZON.COM budget. Thus, this type of alert 214 is passive or informative in that there is no input by the consumer 215 or restrictions placed on the consumer 215. At 804, the consumer 215 can close the alert window 850 and decide whether to proceed with or terminate the on-line transaction utilizing the user interface of the merchant website 215.

Further, in certain embodiments, at 806, the plug-in 213 may generate and send an electronic message, such as an electronic mail message, to another computer or mobile communication device informing the recipient of the alert 214. For example, such communications may be utilized in situations in which a parent wants to monitor on-line purchases of child, sets a budget for spending by the child using the FMS 240, and is alerted when the child is attempting to or has completed an on-line transaction that goes over the parent-specified budget.

Figure 9A:
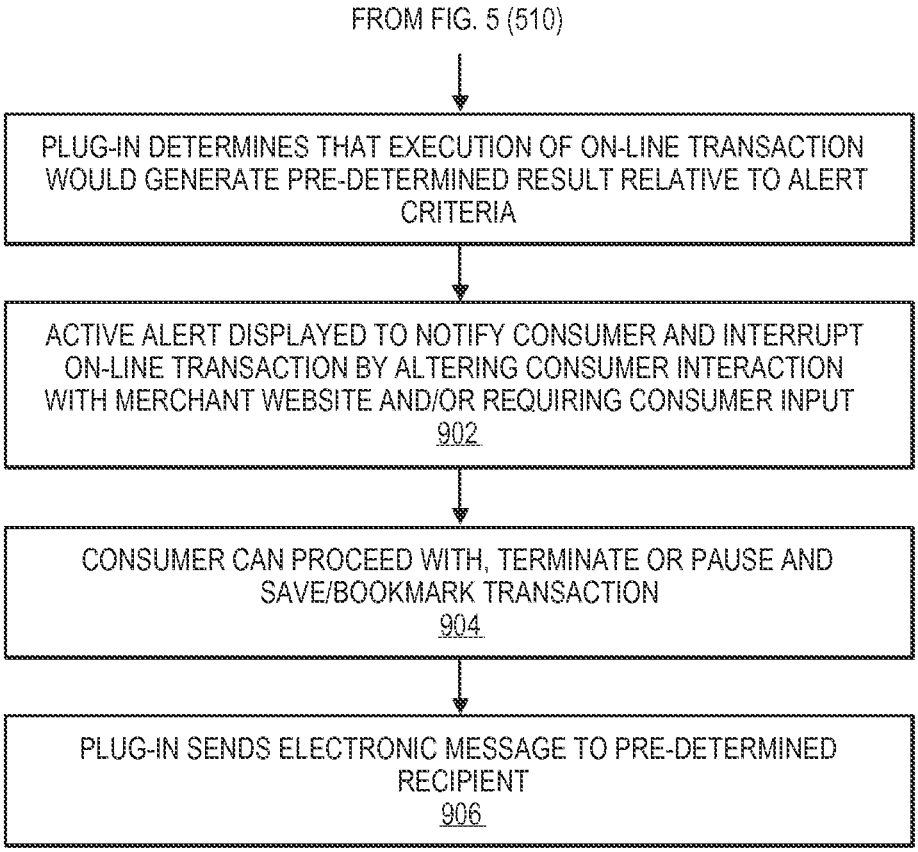
FIG. 9A is a flow diagram of generating an active alert during an on-line transaction according to one embodiment.

Referring to FIG. 9A, according to another embodiment, step 510 of FIG. 5 involves the plug-in 213 determining that execution of on-line transaction would generate pre-determined result relative to alert criteria 247 as discussed above, and at 902, the plug-in 213 generates and displays an alert 214 that is active. According to certain embodiments, the active alert 214 may also be in the form of a window message but provides for some type of input or control by the consumer 215 (other than closing the window message as in a passive alert), interrupts the consumer 215, alters the consumer's interaction with the merchant website 221, and/or prevents the consumer 215 from completing the on-line transaction.

Figure 9B:
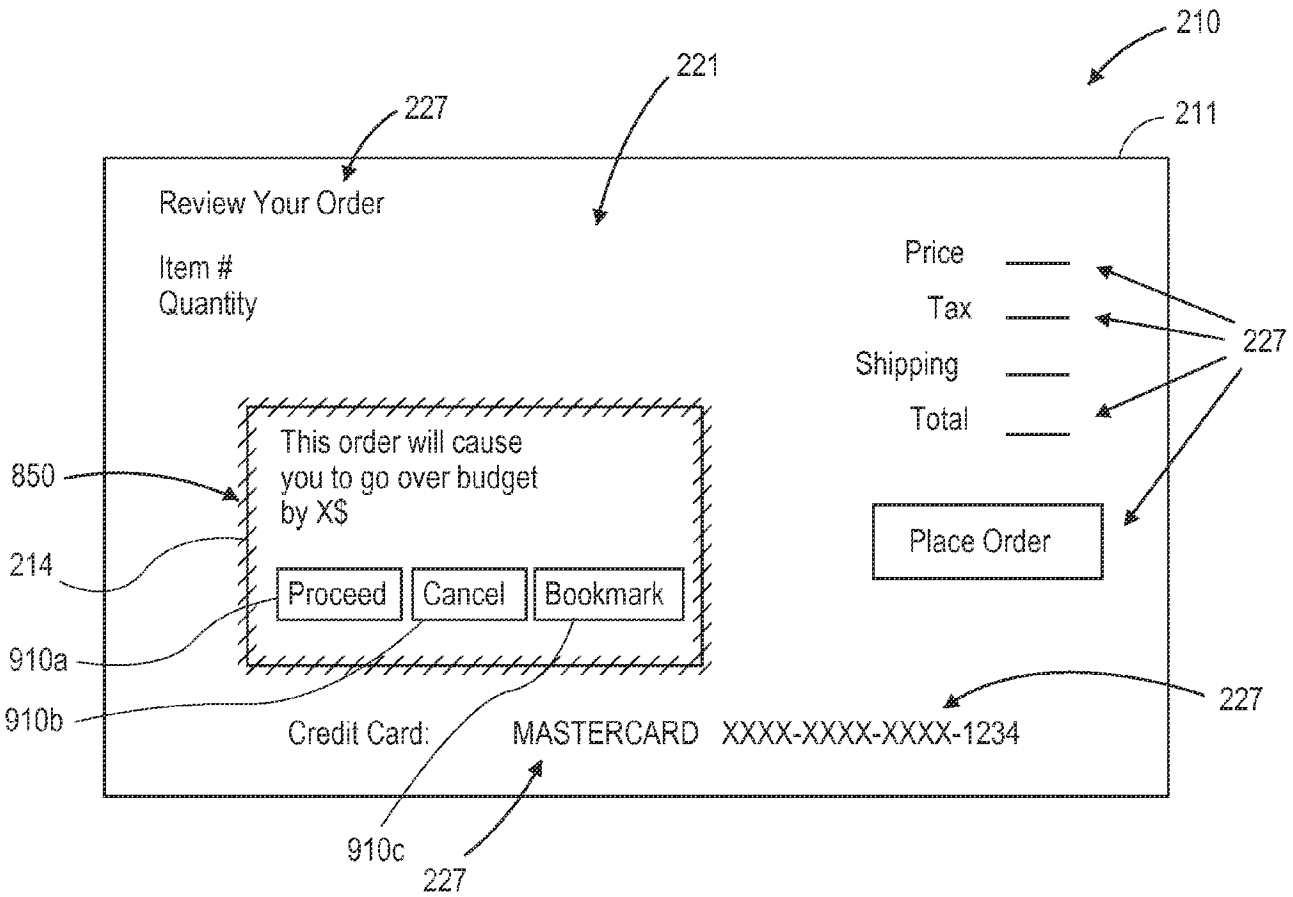
FIG. 9B illustrates an example of an active alert in the form of a pop-up window with user input elements that may cause interruption to or block the pending on-line transaction.

Referring to FIG. 9B, according to one embodiment, an active alert 214 is in the form of a window or other message including one or more input elements or buttons that can be selected by the consumer 215. In the illustrated embodiment, the active alert 214 includes a first input element or button

910*a* that can be clicked or selected to allow the consumer 215 to proceed with the on-line transaction, a second input element or button 910*b* that terminates the transaction, e.g., by closing the browser 212, closing the merchant webpage 221 or directing the consumer 215 from the merchant website 221 to another website such as a home page, and a third input element 910*c* allows allow the consumer 215 to save or bookmark the current location so that the on-line transaction can be completed at a later time. Thus, in these examples, the plug-in 213 interrupts or delays the consumer's interaction with the merchant website 221. For these purposes, the plug-in 213 may be configured to override the merchant website 221 or interface or interact with the merchant website 221 to achieve the desired interruption or restrictions placed upon the consumer 215.

While certain types and numbers of input elements 910 have been disclosed, it will be understood that embodiments may include different numbers of input elements 910 that provide for different functionality, that an alert 214 may be positioned to block or certain merchant website elements or buttons. For example, the alert 214 can be positioned within a web page displayed to cover a "place order" button "proceed to checkout" button to prevent the consumer 215 from pressing the last button to complete the transaction and block or temporarily halt the transaction. An active alert 214 may even terminate the on-line transaction by closing the merchant website 221, redirect the consumer 215 to another webpage such as a home page, or close the browser 221. Further, similar to a passive alert as described above, the plug-in 213 may generate and send an electronic message, such as an electronic mail message, to another computer or mobile communication device informing the recipient of the active alert 214 at 906.

In other embodiments, rather than input elements 910 as shown in FIG. 9B, the active alert 214 may be a window with an alert message that allows the consumer to proceed only after the pre-determined waiting or cooling off period. For this purpose, the alert 214 may include a timer that counts down the time when the consumer 215 is allowed to continue with the on-lien transaction. Further, in another embodiment, the plug-in 213 may require the consumer 215 to log into the FMS 240 to view the account or budget that is the subject of an alert 214. For this purpose, the plug-in 213 can be configured or programmed to interface with the FMS 240 via the API 227, present fields for entry of a username and password or other login information by the consumer 215, and connect the consumer 215 to the FMS 240 and pertinent account or budget for which the alert 214 was generated to allow the consumer 215 to view the account or budget. In yet another embodiment, the active alert 214 blocks or terminates the on-line transaction without input by the consumer 215. Accordingly, it will be understood that various types of active alerts 214 having different interruptive effects upon the consumer 215 can be implemented, and active alerts 214 may or may not allow for consumer 215 input, and may or may not allow the consumer 215 to proceed with the on-line transaction.

FIGS. 10A-F illustrate examples of the data maintained by the plug-in 213 locally on the consumer computer 210 and/or the FMS 240 on the host computer 230, and how alert criteria 247 based upon an account, financial summary, budget or profile 245 of the consumer 215 utilized to determine whether an alert 214 should be generated and displayed during an on-line transaction.

Referring to FIG. 10A, the consumer 215 may have selected a budget of $200 for the month of April. The budget may be for on-line purchases made during a particular time (e.g., during April), from a particular merchant or of a particular item or category thereof. The FMS 240 maintains a table or other data structure that is used to track consumer spending (e.g., based upon checking account and/or credit card account transaction histories) relative to the budget to determine if or when an alert should be issued during an on-line transaction. In the illustrated example, the table includes columns 1002*a-d* for prior transactions on April 1 and April 3 in the amounts of $20 and $75, the resulting remaining budget of $105, and an indication of whether the consumer has gone over budget and whether an alert should be issued. The bottom row includes data of a current on-line transaction that consumer 215 is currently in the process of completing. In this example, the plug-in 213 determines the amount of the current on-line transaction, accesses the transaction/budget data in the table, and determines that if this on-line transaction is completed, the consumer 215 will go over budget by $45 such that an alert 214 should be generated and displayed to the consumer 214 before the transaction is completed.

FIG. 10B illustrates another example in which the plug-in 213 determines whether to generate and display an alert if the current on-line transaction that has not yet been completed would cause the consumer 215 to come within a pre-determined amount (e.g., $25 as shown in column 1002*e*) of the budget amount (e.g., $200). In this example, the current on-line transaction in the amount of $100 (bottom row) would cause the consumer 215 to come within $5 of the budget amount. As such, the plug-in 213 would generate an alert 214 since the on-line transaction would cause the consumer 215 to come within the pre-determined amount of the budget, even if the consumer 215 would not go over budget.

Referring to FIG. 10C, a further example, instead of generating an alert 214 if the consumer 215 goes over budget, the alert 215 is generated if the current transaction that is not yet completed would cause the consumer 215 to exceed the amount of available credit. In the illustrated example, a table, based on $5,000 of credit available, includes columns 1012*a-e* for a starting credit card account balance ($4,000), transaction amounts, remaining credit following the transactions, indications whether the consumer 215 has or will exceed the amount of available credit and whether an alert 214 should be generated. In the illustrated example, the last completed transaction resulted in the consumer having $550 in available credit, whereas the current on-line transaction that consumer is currently in the process of completing (bottom row) is in the amount of $800. With these inputs, the plug-in 213 determines that the consumer 215 will exceed the available credit such that an alert 214 should be generated and displayed to the consumer 215.

FIG. 10D illustrates another example in which the plug-in 213 determines whether to generate and display an alert 214 if the current on-line transaction that has not yet been completed would cause the consumer 215 to come within a pre-determined amount (e.g., $200 as in column 1112*f*) of the credit limit in which case the plug-in 213 may generate an alert 214 even if the consumer 215 would not exceed the amount of available credit.

Referring to FIG. 10E, a further example involves generating an alert 214 if the bank account (e.g., a checking account) that will be utilized to pay the credit card bill resulting from the current on-line transaction that is not yet completed would cause the consumer's account balance to fall below a per-determined minimum balance. In the illustrated example, the table, based on maintaining a minimum account balance of $2,000, includes columns 1032*a-e* for a starting account balance ($3,000) (Start Bal), transaction amounts, account balances after the transactions (End Bal), indications whether the account balance would fall below a pre-determined minimum balance (Min Bal) and whether an alert 214 should be generated. In the illustrated example, the last completed transaction resulted in the consumer 215 having an account balance in the amount of $2550, whereas if that account will be utilized to pay for a current on-line transaction in the amount of $800 (bottom row) that the consumer 215 is currently in the process of completing, that account balance would fall to $1750 (less than the minimum balance of $2000). With these inputs, the plug-in 213 determines that the consumer's account balance will fall below the minimum balance and generates and displays an alert 214 to the consumer 215.

FIG. 10F illustrates another example in which the plug-in 213 determines whether to generate and display an alert 214 if the current on-line transaction that has not yet been completed would cause the consumer 215 to come within a predetermined amount (e.g., $200 as in column 1122*f*) of the minimum balance, in which case the plug-in may 213 generate an alert 214 even if the consumer's account balance would be remain higher than the minimum balance.

Figure 11:
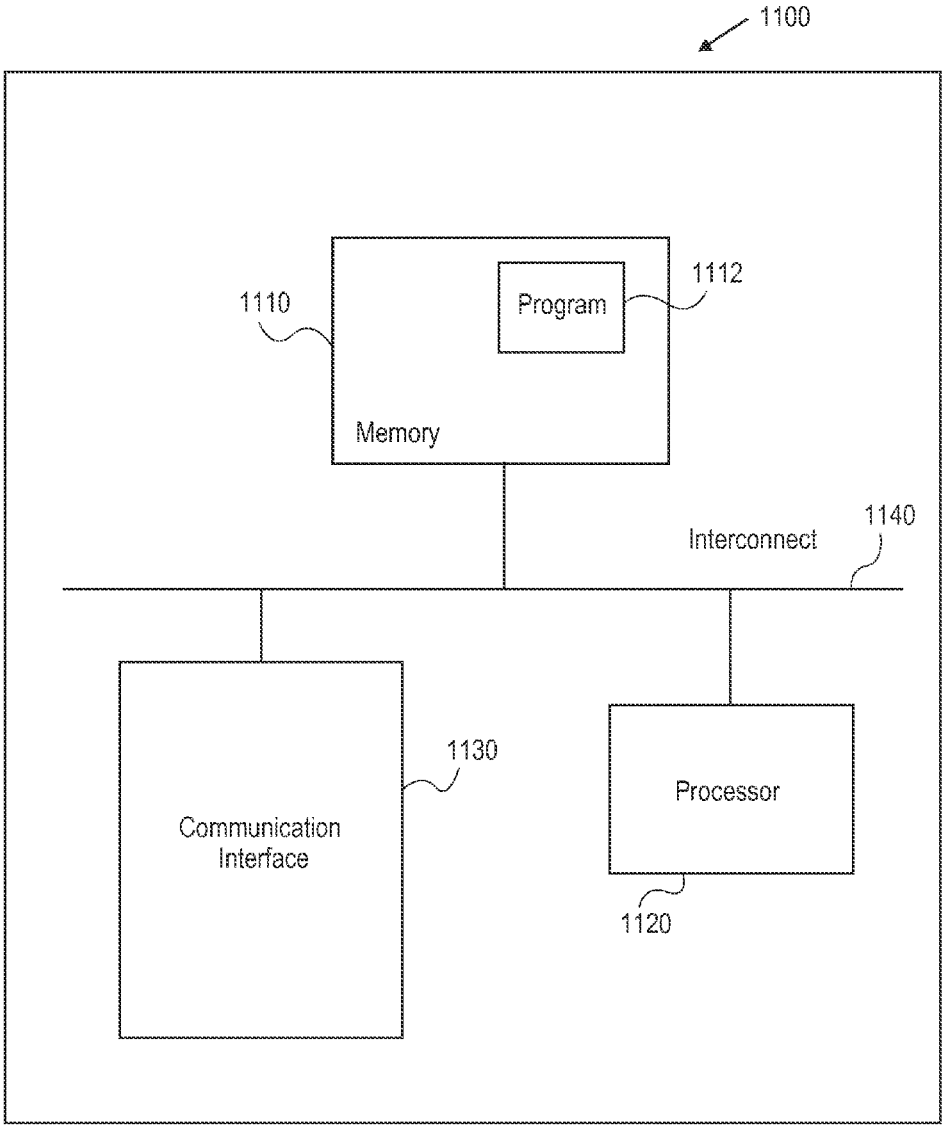
FIG. 11 is a block diagram of components of a computing apparatus or system in which various embodiments may be implemented or that may be utilized to execute various embodiments.

FIG. 11 generally illustrates components of a computing device 1100 that may be utilized to execute embodiments and that includes a memory 1110, account processing program instructions 1112, a processor or controller 1120 to execute account processing program instructions 1112, a network or communications interface 1130, e.g., for communications with a network or interconnect 1140 between such components. The memory 1110 may be or include one or more of cache, RAM, ROM, SRAM, DRAM, RDRAM, EEPROM and other types of volatile or non-volatile memory capable of storing data. The processor unit 1120 may be or include multiple processors, a single threaded processor, a multi-threaded processor, a multi-core processor, or other type of processor capable of processing data. Depending on the particular system component (e.g., whether the component is a computer or a hand held mobile communications device), the interconnect 1140 may include a system bus, LDT, PCI, ISA, or other types of buses, and the communications or network interface may, for example, be an Ethernet interface, a Frame Relay interface, or other interface. The network interface 1130 may be configured to enable a system component to communicate with other system components across a network which may be a wireless or various other networks. It should be noted that one or more components of computing device 1100 may be located remotely and accessed via a network. Accordingly, the system configuration provided in FIG. 11 is provided to generally illustrate how embodiments may be configured and implemented.

Method embodiments may also be embodied in, or readable from, a computer-readable medium or carrier, e.g., one or more of the fixed and/or removable data storage data devices and/or data communications devices connected to a computer. Carriers may be, for example, magnetic storage medium, optical storage medium and magneto-optical storage medium. Examples of carriers include, but are not limited to, a floppy diskette, a memory stick or a flash drive, CD-R, CD-RW, CD-ROM, DVD-R, DVD-RW, or other carrier now known or later developed capable of storing data. The processor 1120 performs steps or executes program instructions 1112 within memory 1110 and/or embodied on the carrier to implement method embodiments. Further, embodiments may reside and execute on a mobile communication device such as a cellular telephone or Smartphone.

Although particular embodiments have been shown and described, it should be understood that the above discussion is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims.

For example, while certain embodiments are described with reference to a consumer or individual navigating merchant website to purchase an item on-line, it will be understood that embodiments may be utilized by other types of consumers including corporate and government consumers, in which case the corporate or government consumer, for example, may select or specify budgets related to available cash flow or credit.

Further, while embodiments are described with reference to performing screen scraping, scanning or reading data of one or a small number of pages of the merchant's website, it may be the case that the consumer navigates other numbers of pages or screens including tens or hundreds of pages or screens, and the plug-in may scrape, scan or read all of these pages to determine whether to issue an alert to a consumer.

Moreover, while certain embodiments are described with reference to key words or phrases that indicate an on-line transaction is in the process of being completed, it will be understood that other terminology may also be utilized, and the data accessed by the plug-in can be updated or revised accordingly to include transaction indicators of other websites of other merchants. For example, while one merchant may refer to "proceed to checkout" other merchants may refer to "complete purchase." Thus, it will be understood that embodiments may be utilized to generate and display an alert to a consumer at various stages of an on-line transaction in real time, at the point of sale, before the on-line transaction is completed.

Moreover, while embodiments are described with reference to a FMS such as MINT, QUICKEN, FINANCEWORKS and MICROSOFT MONEY, embodiments may also be utilized with other FMS, and the type of FMS utilized may vary depending on the consumer and on-line shopping needs.

Further, alerts generated by the plug-in may be passive or active, and alerts may include various types of functionality.

The plug-in can also be downloaded from the FMS or host computer or from another source or computer.

It will also be understood that embodiments may involve a consumer using a desktop or laptop computer as well as a mobile communication device such as a Smartphone to browse a merchant website and purchase items on-line. Thus, the plug-in can be downloaded to such computers and mobile communication devices. Further, it will be understood that embodiments implemented using a mobile communication device may involve a browser and add-on as described above or a native application that executes on the mobile communication device and that is utilized for on-line purchases. A native application may or may not utilize an add-on to implement embodiments depending on how the native application is configured, but in in both browser/add-on and native application embodiments, an alert is displayed to the consumer before a transaction is completed.

Additionally, while embodiments describe the plug-in accessing data hosted by a FMS to determine whether an alert should be generated, such alert criteria and/or FMS data of the consumer's account or financial summary can be stored locally on the consumer computer or mobile communication device such that it is not necessary to access the host computer each time. Instead, the locally stored transaction indicators, alert criteria and FMS or financial summary data can be stored locally.

While embodiments are described with reference to an individual consumer and a particular merchant, embodiments may also be applied to the same consumer and multiple merchants, multiple consumers and the same merchant, and multiple consumers and respective merchants so that different consumers can be alerted as necessary based on their respective alert criteria and FMS accounts or financial summaries.

Additionally, while the on-line transaction and plug-in are described with reference to payment in the form of a credit card, the merchant website may accept, and the plug-in can analyze, other types of payments including, but not limited to debit card, check, electronic check, ATM withdrawal, ACH and other forms of electronic payment.

Further, according to other embodiments, the plug-in is configured to determine the amount of the on-line transaction, and if the amount is less than a pre-determined amount, the plug-in may skip over on-line transactions involving smaller amounts but analyze on-line transactions involving large amounts. For example, a plug-in may be configured to ignore transactions involving $20 or less so that the consumer is not alerted when transaction amounts are not significant.

Moreover, while certain embodiments are described with reference to a particular account balance or available credit, the plug-in may also be configured or operable to determine whether an alert should be generated and displayed based at least in part upon the result of the transaction causing the new balance or available credit to come within a pre-determined amount of the balance or available credit of the alert criteria. This provides some flexibility or cushion. For example, the consumer may specify that an alert should be generated when an on-line transaction would cause a savings account balance to fall within $100 of $500, or if the available credit would fall within $300 of $1000 of available credit.

Embodiments may also be applicable to monitor, interrupt or limit on-line purchases or on-line transactions for different purposes such as a parent monitoring spending by a child or a spouse monitoring spending of another. Other applications may involve monitoring individuals with on-line gambling problems such that if the individual is engaged in on-line gambling for a certain amount of time, has placed a bet that is too large, or has lost or will lose too much money than allowed by the alert criteria, an alert can be generated by the plug-in to interrupt, halt or block any further on-line gambling activities.

Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially.

Accordingly, embodiments are intended to exemplify alternatives, modifications, and equivalents that may fall within the scope of the claims.

What is claimed is:

1. A computer-implemented method for alerting a consumer during an on-line transaction, the method comprising:

a first computer utilized by the consumer and executing a web browser allowing the consumer to access a website of a merchant through a first network, the website being hosted by a second computer;

the first computer detecting when the consumer is in the process of purchasing an item from the merchant during an on-line transaction through the website;

the first computer communicating with a financial management system and receiving data of an account the consumer has with the financial management system in response to detecting the on-line transaction, the account data comprising alert criteria received by the first computer before the on-line transaction is completed;

the first computer comparing data of the on-line transaction and the alert criteria; and the first computer generating an alert that is displayed to the consumer when execution of the on-line transaction would generate a pre-determined result relative to the alert criteria before the on-line transaction has been completed.

2. The method of claim 1, the first computer detecting that the consumer is in the process of purchasing the item during the on-line transaction based at least in part upon at least one transaction indicator being displayed by the web browser, the at least one transaction indicator comprising at least one of:

a pre-determined URL address or on-line merchant; and a pre-determined word or phrase associated with an on-line transaction.

3. The method of claim 2, the pre-determined word or phrase being related to an electronic shopping cart after the item has been added to the electronic shopping cart.

4. The method of claim 1, the first computer communicating through a second network with a third computer hosting the financial management system, wherein the consumer and respective other users have respective accounts with the financial management system.

5. The method of claim 1, the alert criteria comprising whether execution of the on-line transaction to purchase the item would result in at least one of:

the consumer exceeding a predetermined credit card balance, the consumer exceeding a predetermined budget amount for purchases of the item;

the consumer exceeding a predetermined budget amount for purchases from the merchant, and a balance of a financial account of the consumer dropping below a predetermined balance.

6. The method of claim 1, the first computer being triggered to access the financial management system, compare data of the on-line transaction and the alert criteria and generate the alert in response to the consumer adding the item to an electronic shopping cart of the merchant website.

7. The method of claim 1, the first computer being triggered to access the financial management system, compare data of the on-line transaction and the alert criteria and generate the alert in response to the consumer proceeding to checkout with the item already added to an electronic shopping cart of the merchant website.

8. The method of claim 1, the first computer being triggered to access the financial management system, compare data of the on-line transaction and the alert criteria and generate the alert in response to entry of credit card information on a screen of the merchant website.

9. The method of claim 8, the first computer being triggered to access the financial management system, compare data of the on-line transaction and the alert criteria and generate the alert in response to the consumer manually entering or selecting a type of credit card on a page of the merchant website displayed on a screen of the first computer of the consumer.

10. The method of claim 8, the first computer being triggered to access the financial management system, compare data of the on-line transaction and the alert criteria and generate the alert in response to the consumer manually entering a credit card number or certain digits of the credit card number on a screen of the merchant website.

11. The method of claim 8, the first computer being triggered to access the financial management system, compare data of the on-line transaction and the alert criteria and generate the alert in response to the consumer visiting the merchant website having a pre-determined URL address.

12. The method of claim 1, the alert comprising a passive alert that informs the consumer of the pre-determined result that would occur if the consumer proceeds with completing the on-line transaction.

13. The method of claim 1, the alert comprising an active alert that temporarily interrupts the on-line transaction.

14. The method of claim 13, the active alert comprising the first computer initiating a timer to implement a pre-determined waiting period before the consumer can proceed with the on-line transaction.

15. The method of claim 1, the active alert terminating or blocking completion of the on-line transaction.

16. The method of claim 15, the active alert blocking or covering a button that is to be pressed or selected by the consumer to complete the transaction.

17. The method of claim 15, the active alert terminating the on-line transaction by closing the merchant website.

18. The method of claim 15, the active alert terminating the on-line transaction by closing the browser.

19. The method of claim 15, the active alert terminating the on-line transaction by directing the consumer from the merchant website to a different website.

20. The method of claim 12, the passive alert comprising a popup window displayed on a screen of the first computer of the consumer.

21. The method of claim 13, the active alert comprising at least on input element selectable by the consumer to allow the consumer indicate whether the interrupted on-line transaction should proceed.

22. The method of claim 21, the active alert comprising:

a first input element selectable by the consumer to terminate the interrupted on-line transaction;

a second input element selectable by the consumer to proceed with the interrupted on-line transaction; and a third input element selectable by the consumer to save the interrupted on-line transaction, wherein the first computer bookmarks a web page currently displayed in response to the consumer indicating the interrupted on-line transaction should be saved.

23. The method of claim 1, the first computer executing a plug-in to the web browser for accessing data of the consumer account hosted by a financial management system and initiating the alert.

24. The method of claim 1, the first computer comprising a mobile communication device that communicates with the second computer by wireless or cellular communications.

25. The method of claim 1, further comprising:

the first computer receiving a response to the alert from the consumer; and the first computer determining whether to continue with completing the on-line transaction based at least in part upon the received response.

26. A system for alerting a consumer during an on-line transaction, the system comprising:

an add-on to a web browser executing on a computer of the consumer, the add-on being configured to detect when the consumer is in the process of purchasing an item from the merchant during an on-line transaction involving a website hosted by a computer of a merchant in communication with the consumer computer; and an intermediate computer hosting a computerized financial management system, the intermediate computer being accessible by the consumer computer and other respective computers of other users of the financial management system, the financial management system being in communication with respective computers comprising electronic sources of financial or transaction data through respective networks and being configured to collect, organize and store financial and transaction data of the consumer and respective other users from respective electronic sources, the add-on being configured to be triggered to communicate with the computerized financial management system of the intermediate computer in response to detecting the on-line transaction, the computerized financial management system being configured to provide alert criteria of an account of the consumer hosted by the financial management system to the add-on before the on-line transaction is completed, the add-on being further configured to compare data of the on-line transaction and the alert criteria, and generate an alert that is displayed to the consumer when execution of the on-line transaction would generate a pre-determined result relative to the alert criteria before the on-line transaction has been completed.

27. The system of claim 26, the alert comprising a passive alert that informs the consumer of the pre-determined result if the consumer proceeds with completing the on-line transaction.

28. The system of claim 26, the alert comprising an active alert that temporarily interrupts the on-line transaction.

29. The system of claim 26, the alert comprising an active alert that terminates or blocks completion of the on-line transaction.

30. The system of claim 26, the alert comprising a popup window.

31. The system of claim 26, the add-on comprising a plug-in to the web browser.

32. A computer program product comprising a non-transitory, computer readable storage medium having instructions which, when executed by a first computer of a consumer, cause one or more processors to execute a process for alerting the consumer during an on-line transaction, the process comprising:

detecting, by the first computer, when the consumer is in the process of purchasing an item from the merchant during an on-line transaction involving a second computer of a merchant in communication with the first computer, in response to detecting the on-line transaction:

communicating, by the first computer with a financial management system and receiving data of an account the consumer has with the financial management system, wherein the account data comprises alert criteria of the financial management system, and wherein the account data is accessed by an add-on before the on-line transaction is completed;

comparing, by the first computer, data of the on-line transaction and the alert criteria; and generating, by the first computer, an alert that is displayed to the consumer when execution of the on-line transaction would generate a predetermined result relative to the alert criteria before the on-line transaction has been completed.

* * * * *